US006131218A

United States Patent [19]

Wang

[11] Patent Number: 6,131,218

[45] Date of Patent: Oct. 17, 2000

[54] UPPER MATTRESS SUPPORT DEVICE FOR PLAYPEN

[76] Inventor: Kun Wang, No. 51, Lane 31, Sec. 2, Changping Rd., Taichung, Taiwan

[21] Appl. No.: 09/249,082

[22] Filed: Feb. 12, 1999

[51] Int. Cl.[7] ..... A47D 7/00

[52] U.S. Cl. ..... 5/93.1; 5/99.1; 5/98.1; 5/97

[58] Field of Search ..... 5/93.1, 98.1, 98.3, 5/99.1, 93.2, 97

[56] References Cited

U.S. PATENT DOCUMENTS

| | | | |
|---|---|---|---|
| 5,349,709 | 9/1994 | Cheng | 5/93.1 |
| 5,615,427 | 4/1997 | Huang | 5/98.1 X |
| 5,778,465 | 7/1998 | Myers | 5/93.1 X |
| 5,845,349 | 12/1998 | Tharalson et al. | 5/93.1 X |
| 5,867,850 | 2/1999 | Mariol | 5/98.1 X |
| 5,991,944 | 11/1999 | Yang | 5/93.1 X |

*Primary Examiner*—Terry Lee Melius
*Assistant Examiner*—Frederick Conley
*Attorney, Agent, or Firm*—Bacon & Thomas, PLLC

[57] ABSTRACT

A playpen having a rectangular frame with four upper support bars, and four positioning brackets each secured between two of the four upper support bars. An upper mattress support device for the playpen having a flexible support received in the frame and an upper periphery enclosing each of the upper support bars, a plurality of support members each secured on the flexible support, an upper mattress received in the flexible support and supported on each of the support members, and four fasteners each secured to one of the positioning brackets and each secured to the periphery of the flexible support.

5 Claims, 6 Drawing Sheets

UPPER MATTRESS SUPPORT DEVICE FOR PLAYPEN

BACKGROUND OF THE INVENTION

1. Field of the Invention

The present invention relates to an upper mattress support device, and more particularly to an upper mattress support device for a playpen.

2. Description of the Related Art

A conventional upper mattress support device in accordance with the prior art shown in FIG. 6 is provided on a playpen, which comprises a rectangular frame (50) including four upper support bars (52) and four positioning brackets (54) each secured between two of the four upper support bars (52), a flexible support (55) received in the frame (50) and including an upper periphery enclosing each of the upper support bars (52), an upper mattress (56) received in and supported on the flexible support (55), and two support rods (53) each secured in the frame (50) and each abutting the bottom of the flexible support (55) to support the flexible support (55).

In such a manner, when a baby placed on the upper mattress (56) turns around to concentrate its weight at one side of the flexible support (55), the upper mattress (56) easily wobbles or rocks to incline on the flexible support (55), thereby causing an uncomfortable sensation to the baby. The present invention overcomes the disadvantage of the conventional upper mattress support device.

SUMMARY OF THE INVENTION

In accordance with one aspect of the present invention, there is provided an upper mattress support device for a playpen which includes a rectangular frame including four upper support bars, and four positioning brackets each secured between two of the four upper support bars.

The upper mattress support device comprises a flexible support received in the frame and including an upper periphery enclosing each of the upper support bars; a plurality of support members each secured on the flexible support; an upper mattress received in the flexible support and supported on each of the support members; and four fasteners each secured to one of the corresponding positioning brackets and each secured to the periphery of the flexible support.

Each of the fasteners has a first side and a second side, and includes an abutting edge extending outward from the first side thereof and abutting the bottom of the respective positioning bracket, a flexible locking piece extending upward from the abutting edge to clamp the respective positioning bracket, and a push block extending outward from the second side thereof.

Each of the fasteners contains an elongated slot therein, and the upper mattress support device further comprises a plurality of connecting straps each having a first end secured to the upper periphery of the flexible support, and a second end secured in the elongated slot of one of the corresponding fasteners.

Each of the support members includes two spaced semi-cylindrical sleeves each secured on the flexible support and each abutting the bottom of the upper mattress, a first rod having a first end received in one of the two sleeves and a second end, and a second rod having a first end received in one of the two sleeves and a second end secured to the second end of the first rod. The first rod contains a socket defined in the second end thereof, and the second rod includes a plug formed on the second end thereof and received in the socket.

Further benefits and advantages of the present invention will become apparent after a careful reading of the detailed description with appropriate reference to the accompanying drawings.

DETAILED DESCRIPTION OF THE INVENTION

Figure 1:
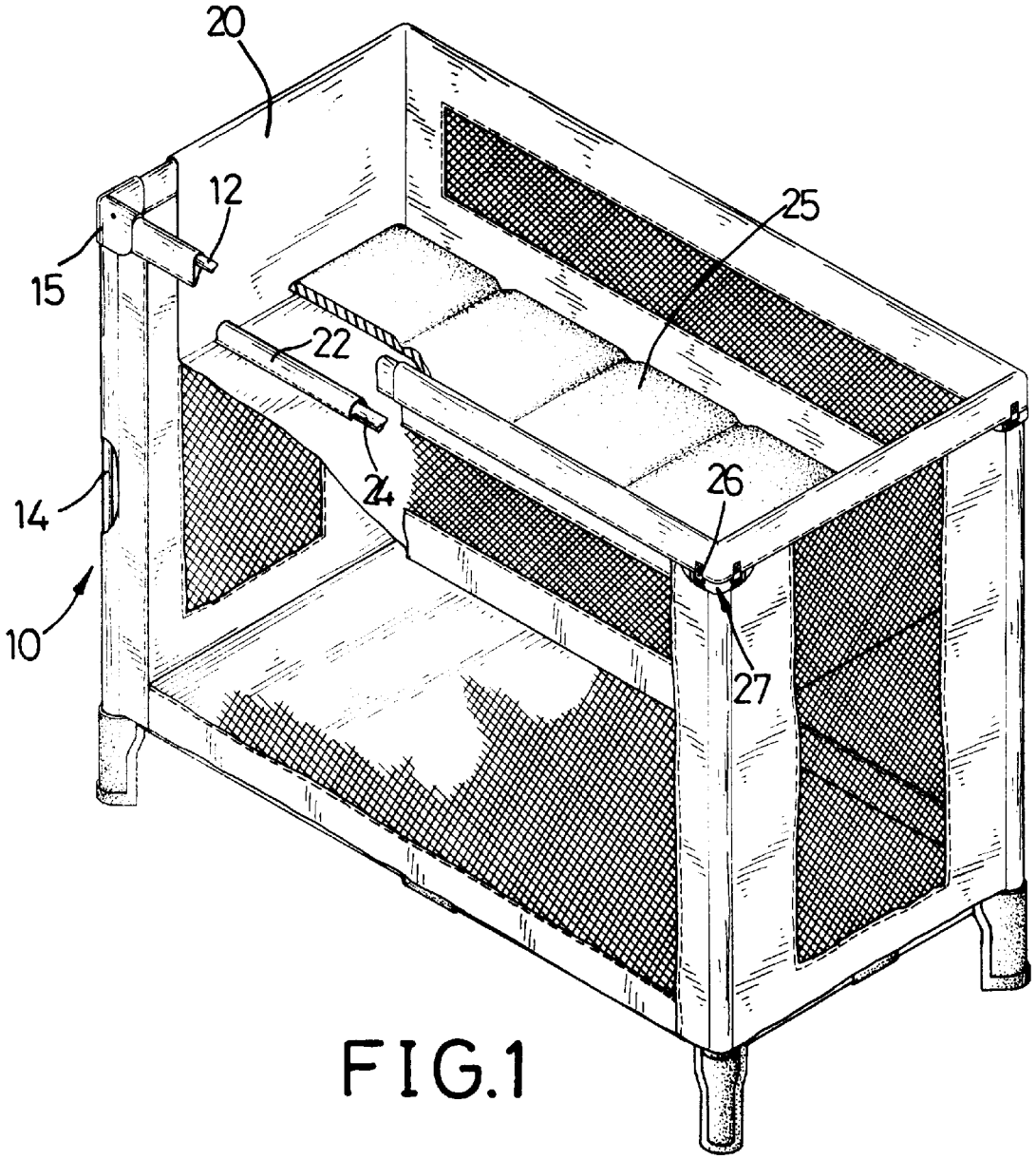
FIG. 1 is a perspective view of an upper mattress support device for a playpen in accordance with the present invention.
Figure 2:
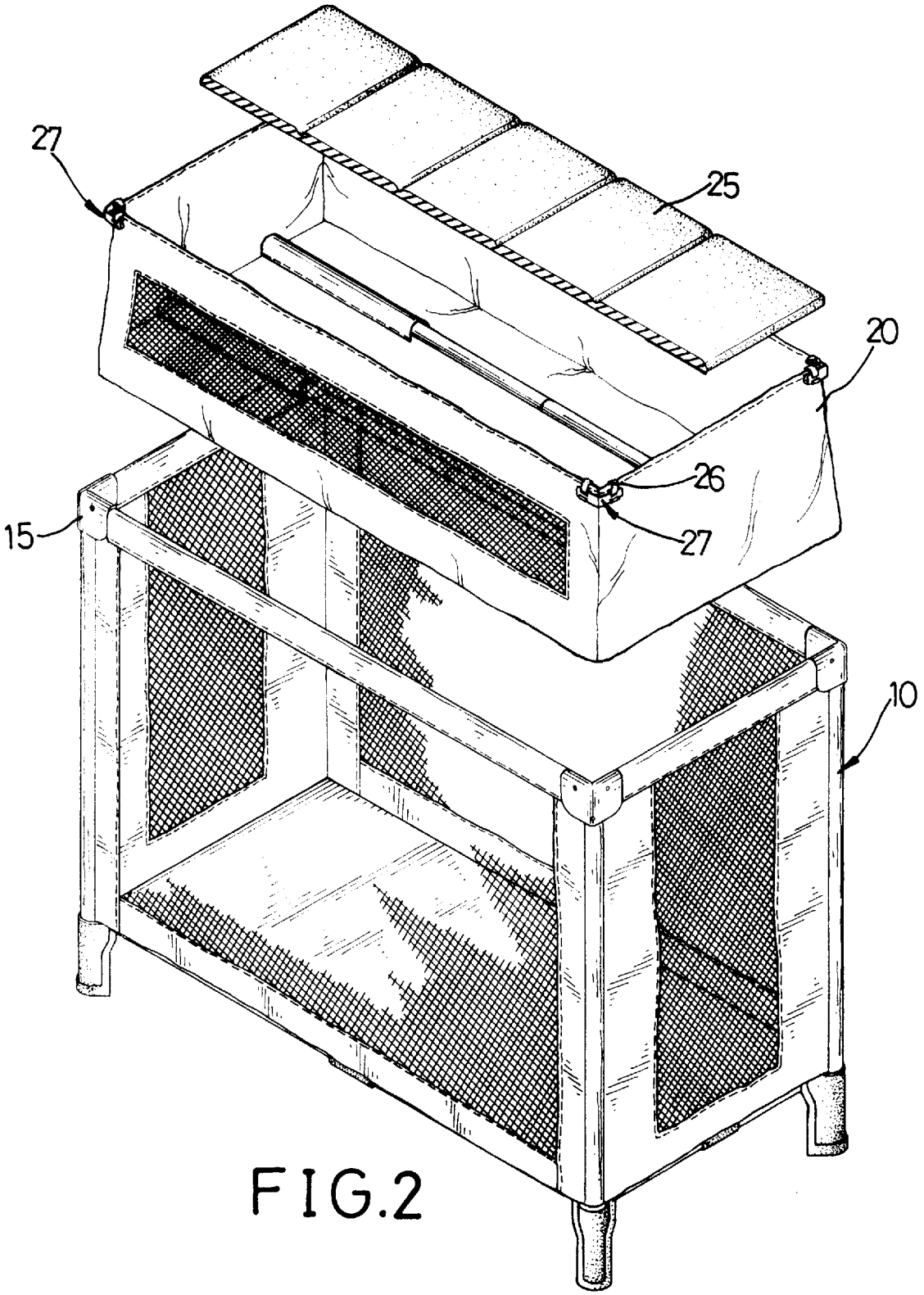
FIG. 2 is an exploded perspective view of the upper mattress support device as shown in FIG. 1.
Figure 3:
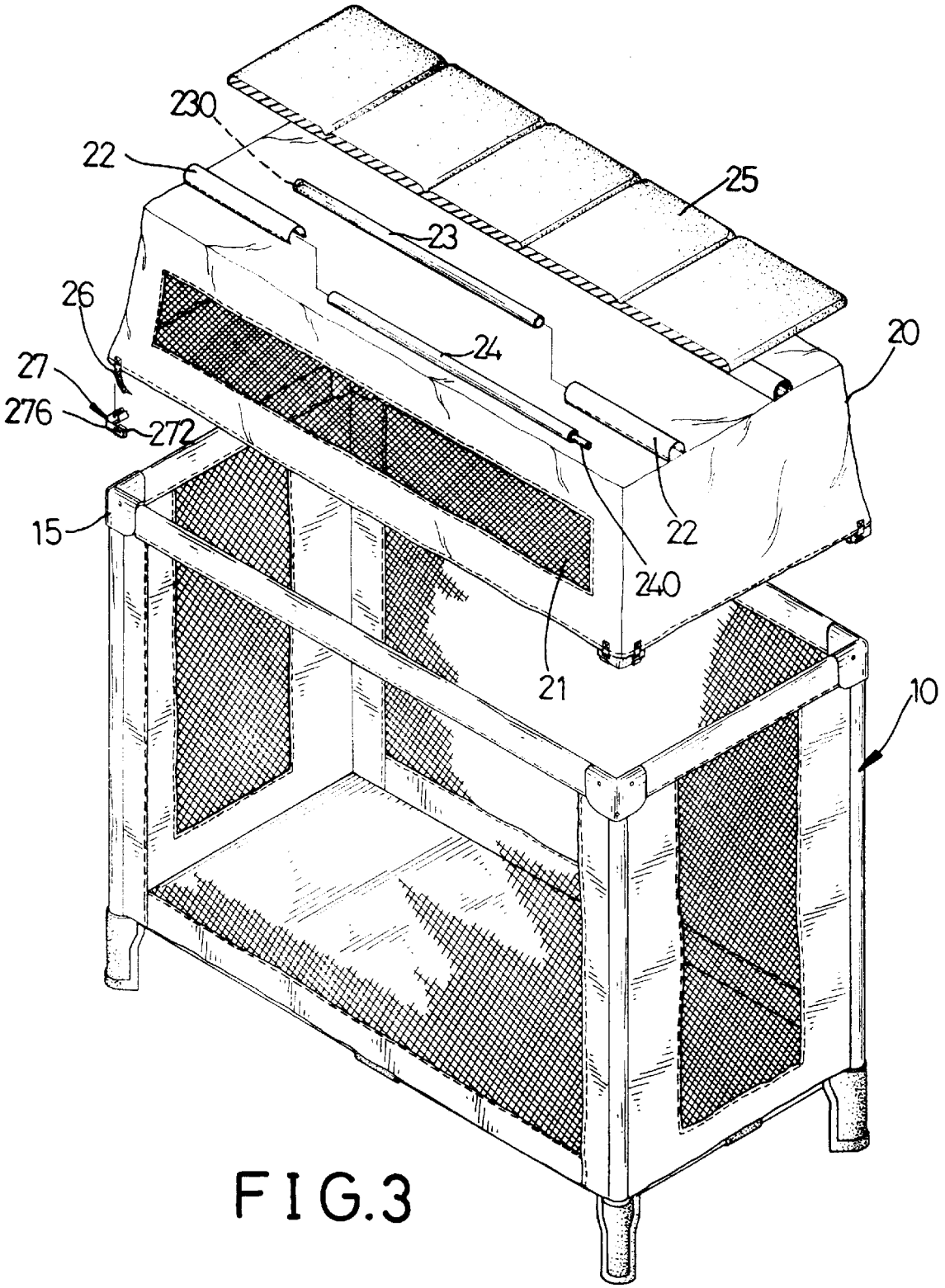
FIG. 3 is an exploded perspective view of the upper mattress support device as shown in FIG. 1.

Referring now to FIGS. 1–3, an upper mattress support device in accordance with the present invention can be adapted to suit a playpen comprising a rectangular frame (10) including four upper support bars (12), four upright stands (14), and four positioning brackets (15) each secured between two of the four upper support bars (12).

The upper mattress support device comprises a flexible support (20) received in the frame (10) and including an upper periphery enclosing each of the upper support bars (12). For illustrative purposes, the flexible support (20) as shown in FIG. 2 is expanded upward or inverted to the position as shown in FIG. 3 such that the elements of the upper mattress support device can be clearly seen.

As shown in FIG. 3, the upper mattress support device further comprises a plurality of support members each secured on the flexible support (20), and an upper mattress (25) received in the flexible support (20) and supported on each of the support members. Each of the support members includes two spaced semi-cylindrical sleeves (22) each secured on the flexible support (20) and each abutting the bottom of the upper mattress (25), a first rod (23) having a first end received in one of the two sleeves (22) and a second end, and a second rod (24) having an end received in the second sleeve (22) and the other end secured to the second end of the first rod (23). The first rod (23) contains a socket (230) defined in the second end thereof, and the second rod (24) includes a plug (240) formed on the second end thereof and received in the socket (230), thereby coupling the first rod (23) and the second rod (24) together so as to support the upper mattress (25).

Figure 4:
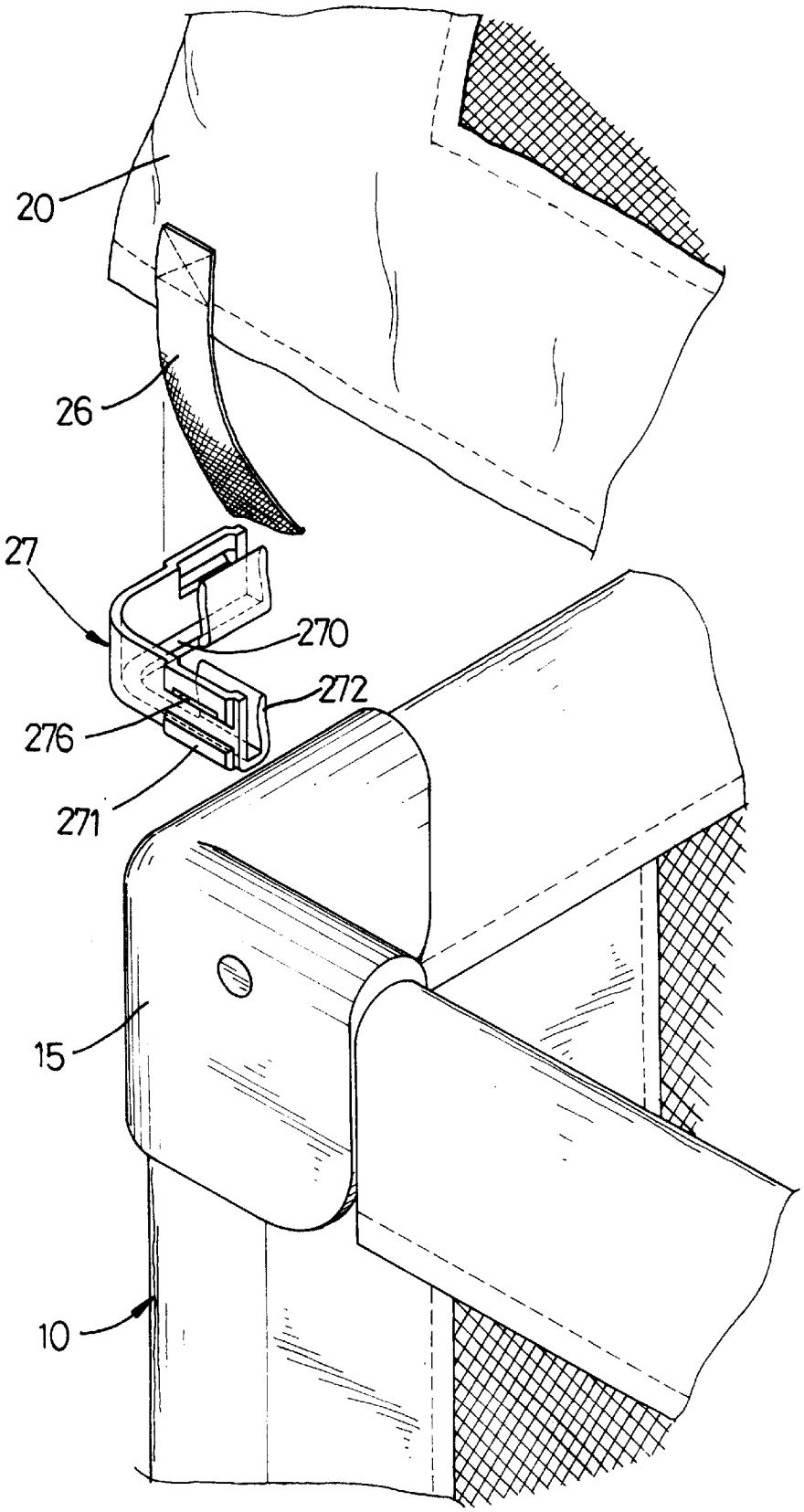
FIG. 4 is an enlarged view of the upper mattress support device as shown in FIG. 3.
Figure 5:
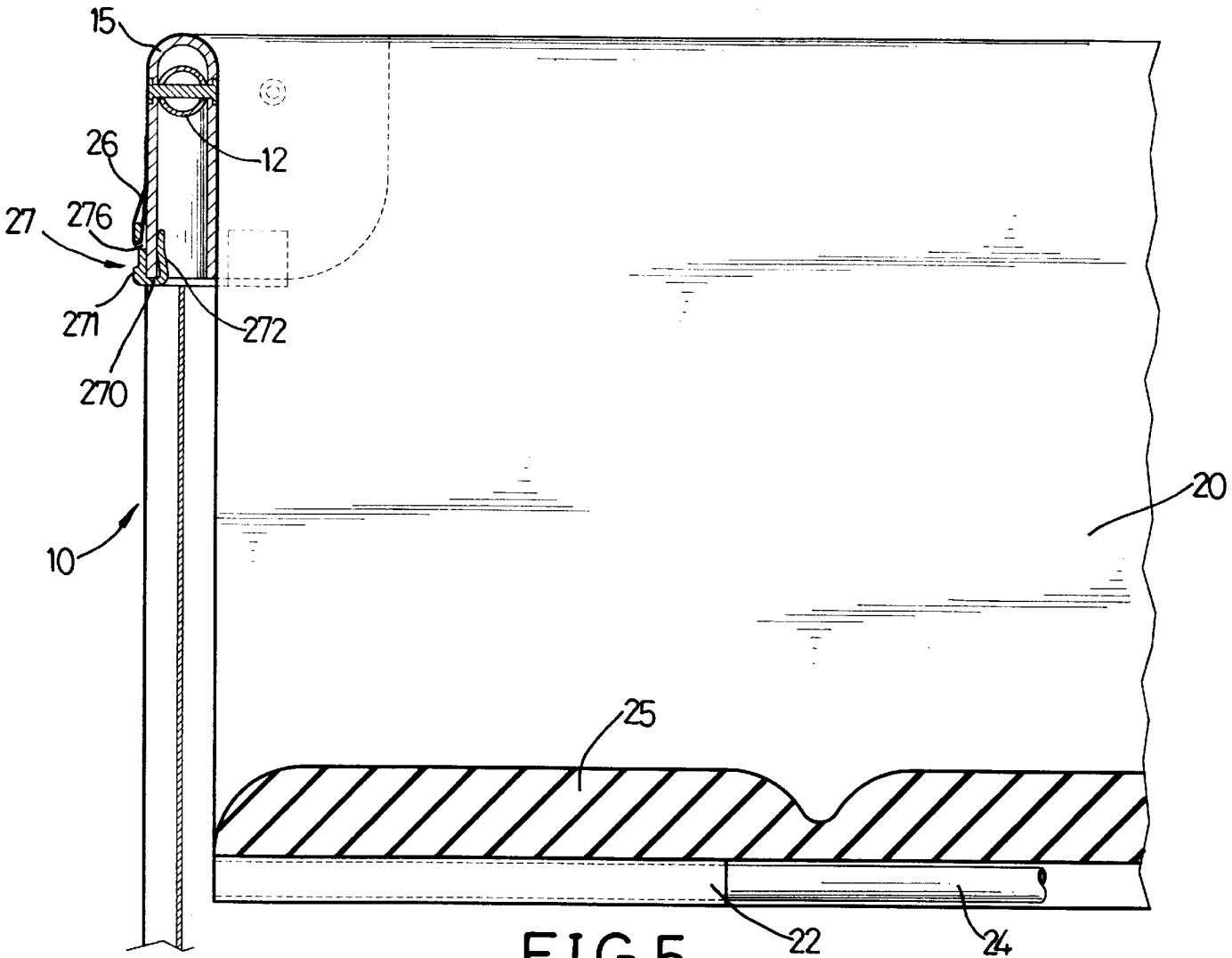
FIG. 5 is a front plan cross-sectional view of the upper mattress support device as shown in FIG. 1.
Figure 6:
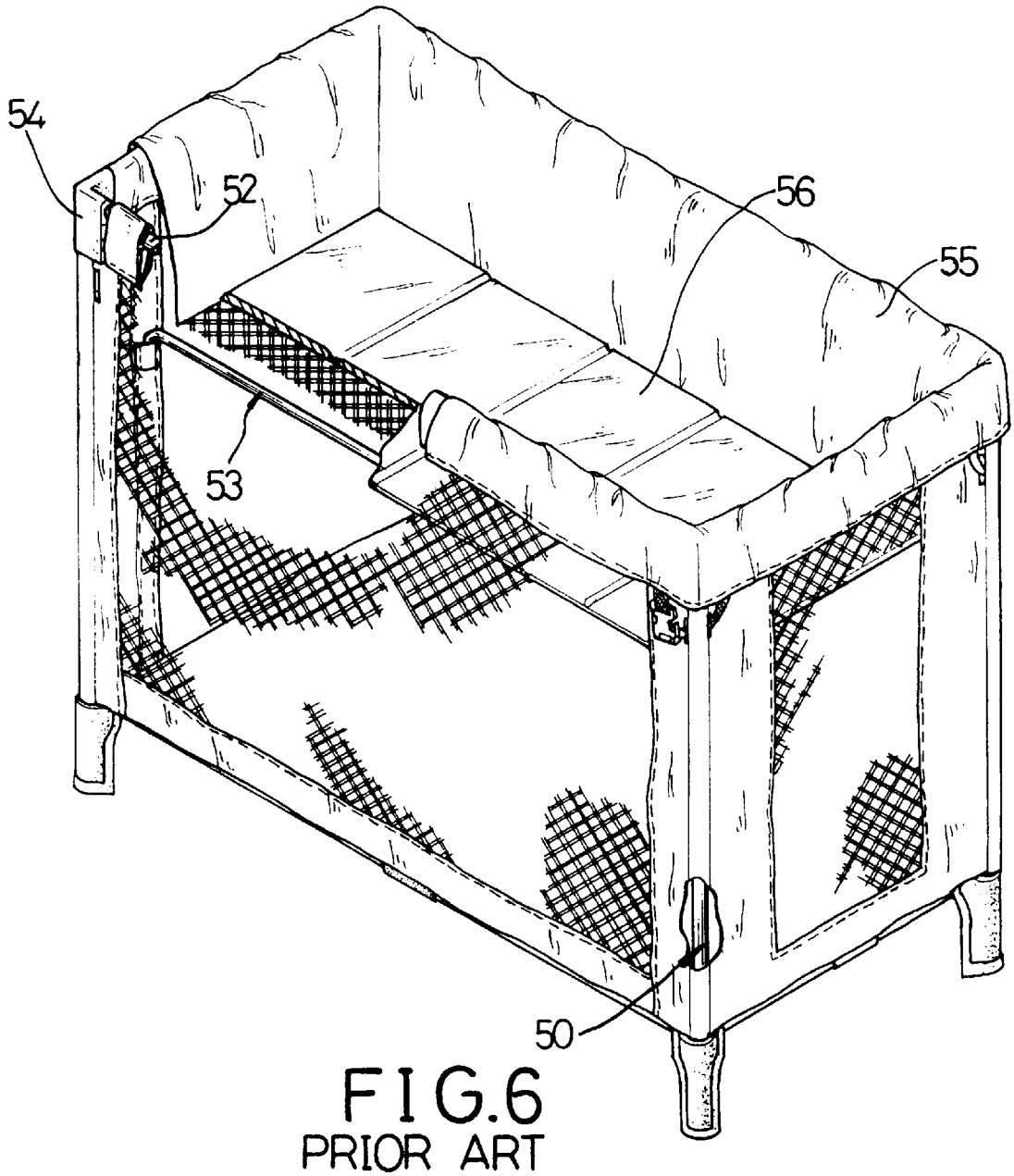
FIG.6 PRIOR ART
FIG. 6 is a perspective view of a conventional upper mattress support device for a playpen in accordance with the prior art.

Referring to FIGS. 3–5 with reference to FIGS. 1 and 2, the upper mattress support device further comprises four L-shaped fasteners (27) each secured to one of the corresponding positioning brackets (15) and each secured to the periphery of the flexible support (20).

Each of the fasteners (27) includes two parts each containing an elongated slot (276) transversely defined therein and each having a first side and a second side, an abutting edge (270) extending outwardly from the first side and abutting the bottom of the respective positioning bracket (15), a flexible locking piece (272) extending upwardly from the abutting edge (270) to clamp the inner side of the respective positioning bracket (15) as shown in FIG. 5, and a push block (271) extending outward from the second side thereof so as to facilitate a user to detach the fastener (27) from the positioning bracket (15).

The upper mattress support device further comprises a plurality of connecting straps (26) each having a first end secured to the upper periphery of the flexible support (20), and a second end extending through the elongated slot (276) of one of the corresponding fasteners (27) which is secured to the connecting strap (26) by any attaching method such as stitching, thereby bonding each of the fasteners (27) to the upper periphery of the flexible support (20).

In assembly, each of the fasteners (27) is initially secured to the upper periphery of the flexible support (20) by the respective connecting straps (26). Then, each of the fasteners (27) is attached to the respective positioning bracket (15), with the abutting edge (270) abutting the bottom of the positioning bracket (15), and with the locking piece (272) clamping the inner side of the positioning bracket (15) as shown in FIG. 5, thereby securing the upper periphery of the flexible support (20) to each of the positioning brackets (15) at the four comers of the frame (10). In such a manner, the upper periphery of the flexible support (20) is smoothly and evenly supported on the four upper support bars (12) of the frame (10) as shown in FIG. 1.

When a baby is placed on the upper mattress (25) of the flexible support (20), the force from the weight of the baby or infant will be exerted on the flexible support (20), thereby stretching the flexible support (20). The upper periphery of the flexible support (20) is attached to the four positioning brackets (15) of the frame (10) such that the force can be evenly distributed to the connecting straps (26) and the fasteners (27) at the four comers of the frame (10). In such a manner, when the baby turns and concentrates its weight at one side of the flexible support (20), the fasteners (27) located at the four comers of the frame (10) can stably support the weight of the baby, thereby preventing the flexible support (20) from wobbling or rocking so as to enhance the stability of the flexible support (20).

It should be clear to those skilled in the art that further embodiments may be made without departing from the scope and spirit of the present invention.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. An upper mattress support device in combination with a playpen comprising a rectangular frame (10) having four support bars (12) that substantially form a four-sided polygon, and four positioning brackets (15) each secured between two of said four upper support bars (12) at a corner of the four-sided polygon, said upper mattress support device comprising:

a flexible support (20) received in said frame (10) and including an upper periphery overlapping each of said upper support bars (12);

a plurality of support members each secured on said flexible support (20);

an upper mattress (25) positioned on said flexible support (20) and supported by said support members; and four fasteners (27) each secured to a corresponding one of said positioning brackets (15); each one of the fasteners secured to said upper periphery of said flexible support (20), wherein each of said fasteners (27) has a first side and a second side, an abutting edge (270) extending outwardly from the first side thereof and abutting a bottom of the corresponding one of said positioning brackets (15); and a flexible locking piece (272) extending upwardly from said abutting edge (270) to clamp said respective positioning bracket (15).

2. The upper mattress support device in accordance with claim 1, wherein each of said fasteners (27) further includes a push block (271) extending outward from the second side thereof.

3. The upper mattress support device in accordance with claim 1, wherein each of said fasteners (27) further comprises an elongated slot (276) therein, and said upper mattress support device further comprises a plurality of connecting straps (26) each having a first end secured to said upper periphery of said flexible support (20), and a second end secured in said elongated slot (276) of one of the corresponding one of said fasteners.

4. The upper mattress support device in accordance with claim 1, wherein each of said support members includes two spaced semi-cylindrical sleeves (22) each secured on said flexible support (2) and each abutting a bottom of said upper mattress (25), a first rod (23) having first and second ends, said first end of the first rod (23) received in one of said two sleeves (22), and a second rod (24) having first and second ends, said first end received in another one of said two sleeves (22) and the second end of said second rod (24) secured to the second end of said first rod (23).

5. The upper mattress support device in accordance with claim 4, wherein said first rod (23) contains a socket (230) at the second end thereof and said second rod (24) having a plug (240) at the second end thereof, said plug (240) is received in said socket (230).

* * * * *